US011426668B1

(12) United States Patent
Reiner

(10) Patent No.: US 11,426,668 B1
(45) Date of Patent: Aug. 30, 2022

(54) ARTICULATING MECHANICAL TOY

(71) Applicant: Russell Reiner, Boca Raton, FL (US)

(72) Inventor: Russell Reiner, Boca Raton, FL (US)

( * ) Notice: Subject to any disclaimer, the term of this patent is extended or adjusted under 35 U.S.C. 154(b) by 0 days.

(21) Appl. No.: 16/929,880

(22) Filed: Jul. 15, 2020

Related U.S. Application Data

(60) Provisional application No. 62/876,246, filed on Jul. 19, 2019.

(51) Int. Cl.
*A63H 13/02* (2006.01)

(52) U.S. Cl.
CPC ..... *A63H 13/02* (2013.01)

(58) Field of Classification Search
CPC ..... A63H 13/02
USPC ..... 473/34, 36, 37, 45, 62, 330, 368, 376, 473/390
See application file for complete search history.

(56) References Cited

U.S. PATENT DOCUMENTS 1,190,343 A * 7/1916 Tyrrell ..... A63H 27/007 446/62
1,679,356 A * 8/1928 Grunewald ..... B64C 33/00 244/22
1,783,029 A * 11/1930 White ..... B64C 33/00 244/72
2,714,784 A 8/1955 Polk
2,729,022 A * 1/1956 Polk ..... A63H 3/18 446/365
2,846,811 A 8/1958 Polk
3,269,054 A 8/1966 Taylor
5,964,638 A 10/1999 Emerson
5,993,286 A * 11/1999 Tacquard ..... A63H 18/007 446/35
7,607,610 B1 * 10/2009 Sterchak ..... B64C 33/02 244/11
9,216,823 B2 * 12/2015 Matte ..... A63H 27/008
9,533,234 B2 * 1/2017 Tanous ..... A63H 30/04
9,717,236 B2 * 8/2017 Szechenyi ..... A01M 31/06
9,938,007 B2 * 4/2018 Jiang ..... B64C 33/02
2002/0173217 A1 * 11/2002 Kinkade ..... B64C 33/02 446/35

* cited by examiner

*Primary Examiner* — Nini F Legesse
(74) *Attorney, Agent, or Firm* — John Rizvi; John Rizvi, PA—The Patent Professor®

(57) ABSTRACT

An articulating mechanical toy including a universal docking mechanism having a left articulating wing, and a right articulating wing is provided. The left articulating wing assembly and the right articulating wing assembly each include a first linkage that may be attached at a respective one of the opposite ends of the docking mechanism. Each respective wing may also include a pair of movable linkages that are connected in series and are removably attachable to a respective primary linkage. Disposed about each movable linkage are a plurality of feather like elements that are coupled to one another via monofilament suture. The articulating toy mechanism is configured and designed to be controlled by a user (e.g., a child). The mechanical toy may include interchangeable left and right wing assemblies and may be interchangeably, attached to a plurality of toys—such as action figures—via the docking mechanism.

18 Claims, 18 Drawing Sheets

ARTICULATING MECHANICAL TOY

CROSS-REFERENCE TO RELATED APPLICATIONS

This application claims the benefit of U.S. Provisional Patent Application Ser. No. 62/876,246, filed on Jul. 19, 2019 which is incorporated herein in its entirety.

FIELD OF THE INVENTION

The present invention relates generally to toys, and more particularly, to a toy that includes a pair of articulating wings that are designed and otherwise configured to be mechanically controlled by the hands and fingers of a user, said toy may include an alternative pair of interchangeable articulating wings, and may be selectively attached and detached to a plurality of hosts, such as, action figures.

BACKGROUND OF THE INVENTION

In 1903, Wilbur and Orville Wright, two brothers from Dayton, Ohio, became the first people to fly a heavier than air, power-controlled machine, known today as an airplane. Their success, however, did not happen overnight. The brothers had been tinkering with the idea of flight off and on since childhood. It is said that their passion for flight was triggered by a rubber band powered toy helicopter brought to them by their father. Historians corroborate that notion by adding that their experience with that toy that flew across the room and did not simply fall to the ground as expected—was accredited as the object that sparked their interest in flight.

The correlation between the rubber band powered toy helicopter the wright brothers received when they were children and their passion with flight is no coincidence. Research shows that learning through play is an important part of a child's development and in developing interests. It is very well documented that toys can help children learn many different skills that they will later need in their life, such as, problem solving, learning about cause and effect, development of fine and gross motor skills, nurturing their creativity and imagination, and discovering their independence and positive self-esteem.

As a child ages and passes through the developmental stages of preschooler to school-age, it is important that the child be introduced to toys that promote cognitive skill building, creativity, problem solving, and motor skill movement. However, in order for the child to want to play with the toy, the toy must also be attractive, interesting to operate, and must generally produce a level of excitement when handled. Otherwise, the toy could go unused.

With regard to the subject of toys that deal with flight, many toy manufacturers have created toys that fly, but very few teach the mechanics of flight, let alone simulate it. For example, there are toys that are designed to replicate the look of a bird and claim to teach the basic principles of flight. The toy is powered by a wind-up motor connected to a pair of articulating wings that move in a flapping motion to produce thrust, while the toy's wings and tail are adjustable to create lift and to alter the toy's flight path.

These types of toys, however, have their own set of limitations and drawbacks. For example, these toys do not allow children to directly manipulate the wing assembly with their hands or fingers, thereby preventing them from seeing up-close how the wings articulate. It is nearly impossible for a child to see up close how the toy operates. Further still, these toys are also constructed in such a manner that it would render the toy inoperable if the child removed the wing assembly and tried to inspect it, or attach it to another host to see how the wings would function differently. Furthermore, these toys appear to be mechanically complicated and include difficult to maneuver and assemble elements.

Accordingly, there is an established need for a toy that promotes cognitive skill building, creativity, problem solving, and motor skill movement. The toy to include a pair of articulating wings that are designed and otherwise configured to be inspected and manipulated by a child (or user), and can be mechanically controlled by the hands of the user, said toy may include an alternative pair of interchangeable articulating wings, and may be selectively attached and detached to a plurality of hosts, such as action figures.

SUMMARY OF THE INVENTION

The present invention is directed to an articulating toy mechanism that is attractive, interesting to operate, and produces a level of excitement when handled by a child. Furthermore, the toy is designed and configured to promote the development of a child's cognitive skill building, creativity, and problem solving skills.

Introducing a first embodiment of the invention, the present invention comprises a central mechanism, a left articulating wing, and a right articulating wing. The left articulating wing and the right articulating wing are removably attached to the central mechanism.

In another aspect, the docking mechanism may comprise of a body having a pair of opposite right and left ends, each of the opposite right and left ends may include a tight attachment mechanism and a left attachment mechanism, respectively. The central mechanism may also include a front face and a rear face, wherein disposed about the front face of the central mechanism is a textured surface.

In another aspect, the right and left attachment mechanisms may be in the form of a hinge joint that provides movement in one plane of direction.

In another aspect, the central docking mechanism may include a finger holding mechanism disposed about the rear face of the central docking mechanism.

In yet another aspect, the central docking mechanism may include a retaining mechanism positioned below a finger holding mechanism, the retaining mechanism and the finger holding mechanism being disposed about the rear face of the central docking mechanism.

In another aspect, the textured surface may be of a hook and loop material.

In another aspect, the central docking mechanism may include an action button positioned above the retaining mechanism and below the finger holding mechanism, the action button being able to engage and promote movement of the right and left articulating wing assembly.

In another aspect, the left articulating wing and right articulating wing may include a left primary linkage and a tight primary linkage attachable to the left and right attachment mechanisms disposed about the opposite ends of the central docking mechanism.

In another aspect, the left and right articulating wings may include a plurality of linkages coupled to the primary linkage to form a skeleton wing design.

In yet another aspect, the right and left articulating wings may include a plurality of feather-like elements coupled to the primary and plurality of linkages comprising the skeleton wing design.

In another aspect, the articulating toy mechanism may further comprise a control wire attachable to an anchor.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements; and in which.

Like reference numerals refer to like parts throughout the several views of the drawings.

DETAILED DESCRIPTION

Figure 1:
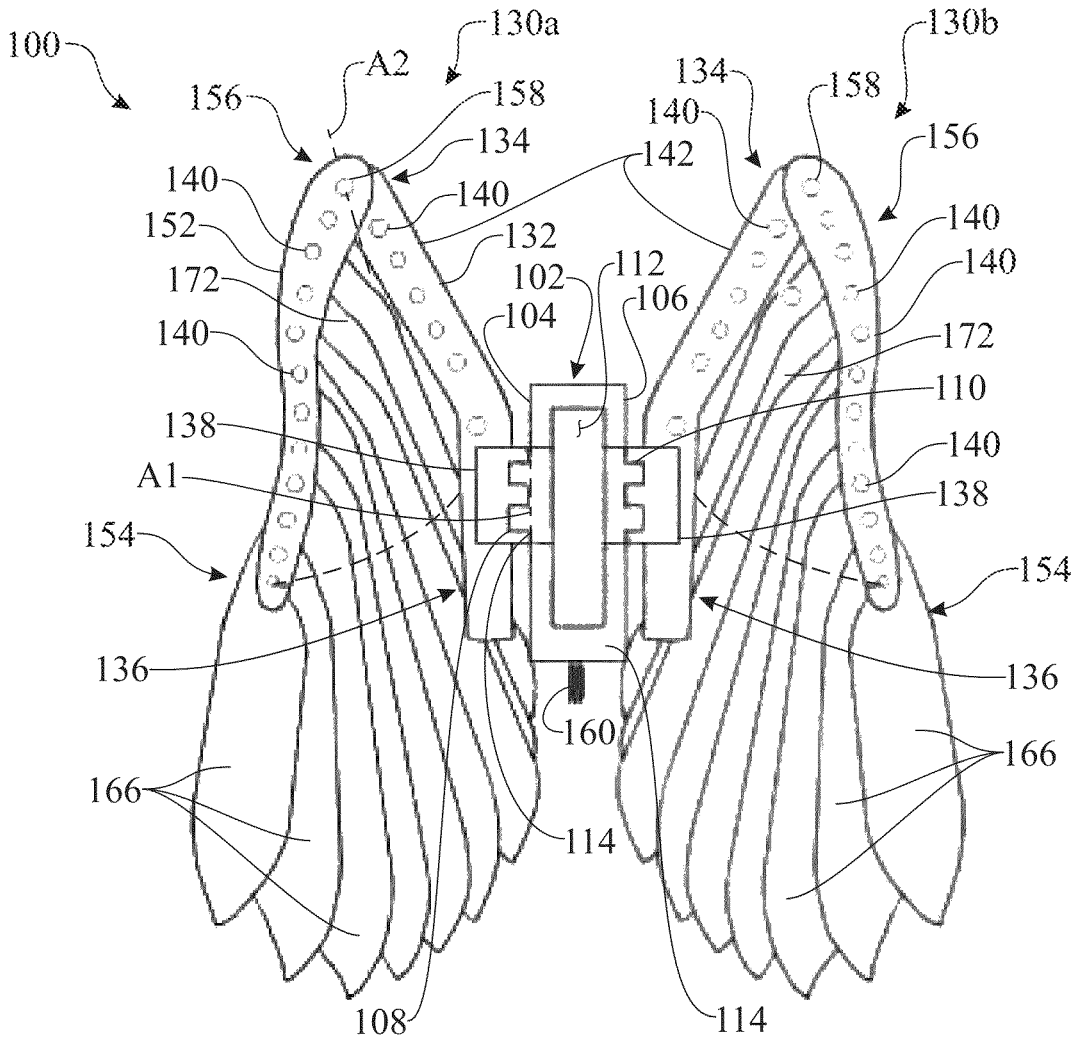
FIG. 1 presents a front side elevation view illustrating a first embodiment of the articulating toy mechanism of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring initially to FIGS. 1-4, an exemplary embodiment of an articulating toy mechanism 100 is generally shown. The articulating toy mechanism 100 generally comprises a central docking mechanism 102, a left articulating wing assembly **130*b*, and a right articulating wing 130*a* assembly, wherein the left and right articulating wing assembly may be coupled to the central docking mechanism 102 to form the articulating toy mechanism 100. The central docking mechanism 102 of the articulating toy mechanism 100 includes a pair of opposite right 104 and left 106 ends. At each opposite end 104, 106 the central docking mechanism may include a right attachment mechanism 108 and a left attachment mechanism 110, respectively. Although the accompanying figures illustrate a right attachment mechanism 108 and a left attachment mechanism 110 in the form of a hinge joint, alternative attachment mechanism that equally provide movement may also be used. The central docking mechanism 102 also includes a front face 114 and a rear face 116. Disposed about the front face 114 of the central docking mechanism is a textured surface 112. It is contemplated that the textured surface 112 be of a material that provides grip (i.e., the material is anti-slip) when in contact with a host (not shown), such as an action figure. The textured surface 112 may also include a hook and loop layer that secures the central docking mechanism 102 to a host and can subsequently be easily removed. In an alternative embodiment (not shown), the articulating toy mechanism 100 may include a mechanical coupling mechanism disposed about the front face 114 of the central docking mechanism 102**, that couples the central docking mechanism 102 to a host. The coupling mechanism may include a female end that engages a male end that may be removably attached to the host.

Figure 2:
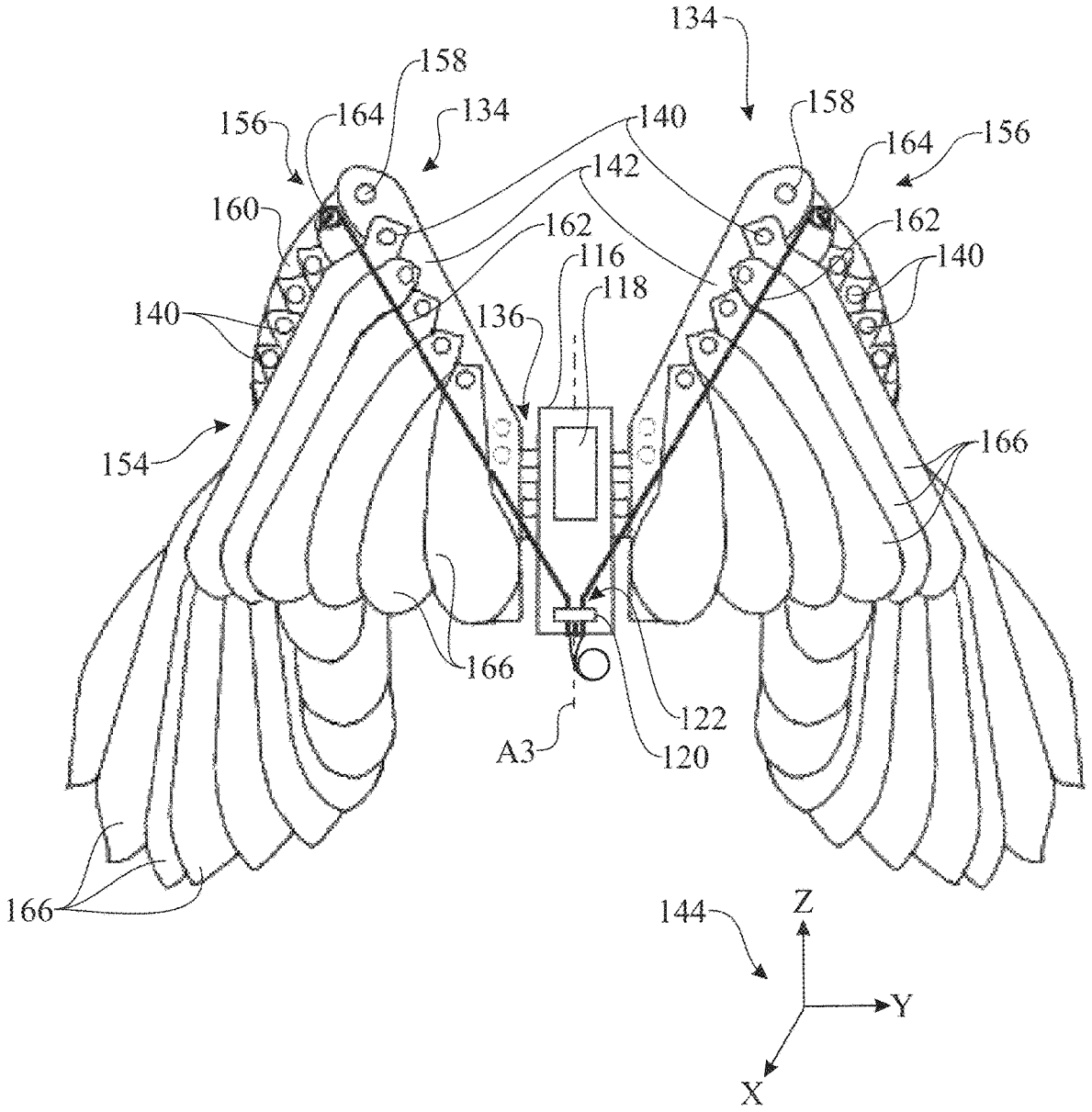
FIG. 2 presents a rear side elevation view of the first embodiment of the articulating toy mechanism of the present invention.
Figure 3:
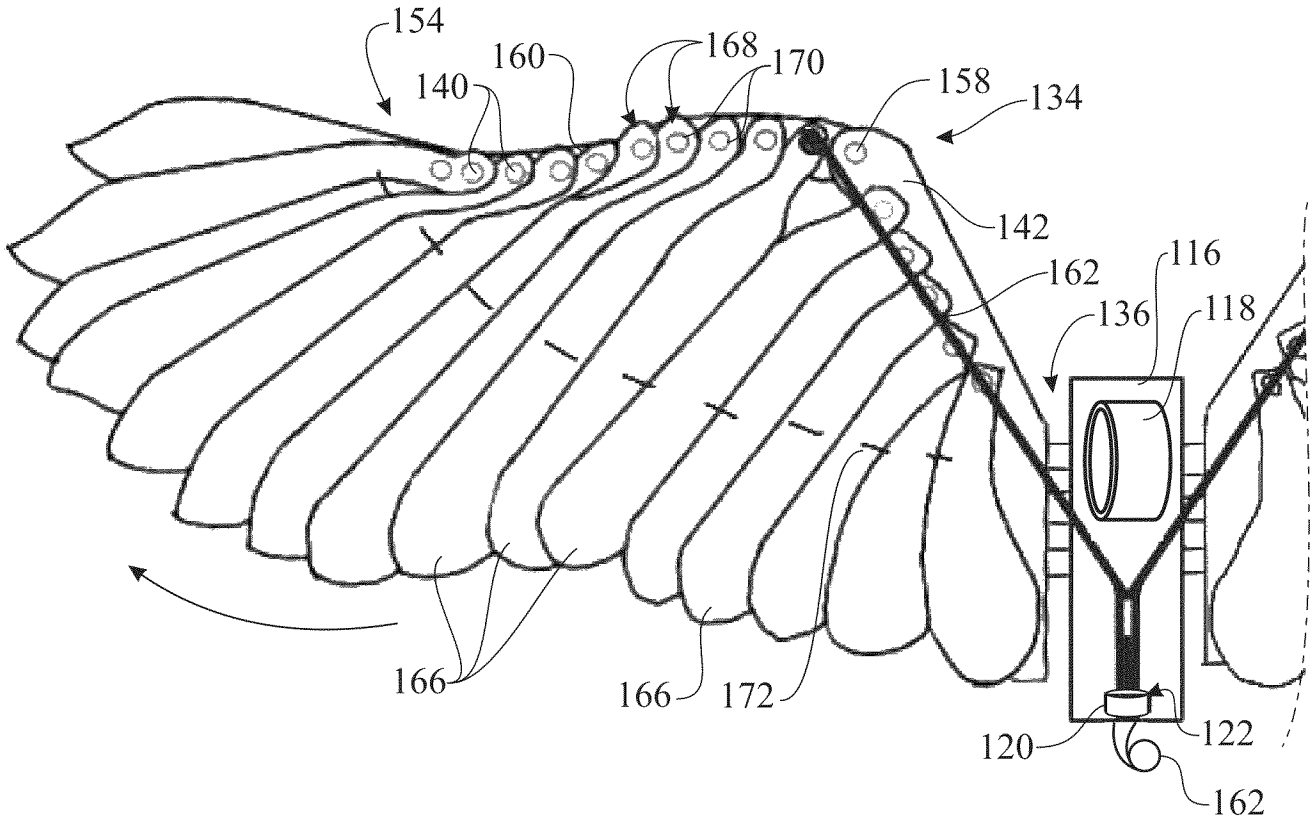
FIG. 3 presents a partial rear side elevation view of the first embodiment of the articulating toy mechanism shown in FIG. 2, illustrating a right articulating wing in an extended or open position.

As is best illustrated in FIGS. 2 and 3, disposed about the rear face 116 of the central docking mechanism 102 is a grabbing mechanism or finger holding mechanism 118. In a preferred embodiment, the finger holding mechanism 118 may be provided in the fora of an annular ring that is sized and fitted to engage at least one finger of a user (e.g., a child). Alternative grabbing mechanism may be utilized. For example, instead of an annular ring, a pop-socket attachment, a handle, or an adjustable and re-sizable mechanism that can engage at least one finger of a user may be utilized. The rear face 116 of the central docking mechanism 102 may also include a retaining mechanism 120. The retaining mechanism may be in the form of an I hook, anchor, or the like which forms a through-hole 122.

The right articulating wing assembly 130*a* and the left articulating wing assembly 130*b* of the articulating toy mechanism 100 comprise the same elements, but are arranged and connected to the central docking mechanism 102 at opposite ends to create a mirror image of one another. Accordingly, for the sake of brevity and clarity like parts and elements will be referenced with identical reference numerals.

Attention is now directed to FIGS. 1 and 2, which shows details of the right and left wing assemblies 130*a*, 130*b*. The left articulating wing assembly 130*b* and the right articulating wing assembly 130*a* each include a primary linkage 132 that has a distal 134 end and a proximal end 136 (relative to the central docking mechanism 102). Each primary linkage 132 may also include an attachment mechanism 138 that is designed and configured to engage with the right attachment mechanism 108 and the left attachment mechanism 110 provided on the opposite left and right ends 106, 104 of the central docking mechanism 102. In one exemplary form, the attachment mechanism 138 is contemplated to be in the form of a hinge joint attachment, which seamlessly connects to the attachment mechanisms 108, 110 that are provided about the opposite ends of the central docking mechanism 102. As can be best seen in FIG. 1, the proximal end 136 of primary linkage 132 may include a portion that is vertical straight and can be placed adjacent to one opposite end of the central docking mechanism 102, with the distal end 134 of the primary linkage 132 generally having a bent portion of an acute angle that projects away from the central docking mechanism 102. In a preferred embodiment, the attachment mechanism 138 of each of the right and left articulating wing assemblies 130*a*, 130*b* is to be included at the proximal end 136 of the primary linkage 132, such that when the primary linkage 132 is coupled at opposite ends of the central docking mechanism 102, the primary linkage 132 may move or swing in a forward and backward motion with respect to the front of the central docking mechanism 102. Primary linkage 132 may further include a plurality of pegs 140 disposed about the primary linkage's back side 142 with the plurality of pegs arranged in series along the linkage's length. The right and left articulating wing assembly 130*a*, 130*b* may also include a secondary linkage 152 that has a distal 154 end and a proximal end 156. The proximal end 156 of the secondary linkage 152 may be coupled to the distal end 134 of the primary linkage 132 at a pivot joint 158. Secondary linkage 152 may also include a plurality of pegs 140 disposed about the linkage's back side 160 with the pegs 140 being arranged in series about the secondary linkage's length.

With reference to FIGS. 1-3, the secondary linkage 152 and the primary linkage 132 when coupled feature a non-collinear relationship. Due to the manner in which the secondary linkage 152 is coupled to primary linkage 132, and the primary linkage 132 is subsequently coupled to the respective opposite end of the central docking mechanism 102, both the secondary linkage 152 and the primary linkage 132 when coupled together may move about a limited angle of rotation relative about a fixed axis A1 on the attachment mechanism 108, 110 on the central docking mechanism 102. Secondary linkage 152, however, may also pivot about the rotational axis A2 of pivot joint 158. In other words, secondary linkage 152 may move about a vertical axis (i.e., up and down direction), and primary linkage 132 and secondary linkage 152 may move in the horizontal direction (i.e., forward and backward relative to the central docking mechanism 102). In a preferred embodiment, the horizontal movement of the primary linkage 132 and secondary linkage 152 of the right and left articulating wing assemblies 130*a*, 130*b* may be actuated through the use of an action button (not shown) disposed about the rear face 116 of the central docking mechanism 102. The action button, in one exemplary form, may be include a spring loaded mechanism that engages the right and left attachment mechanisms 108, 110 to promote said horizontal directional movement.

The movement of the primary linkage 132 and the secondary linkage 152 may be controlled by the pulling, yanking, or otherwise manipulation of at least one control wire 162 that is provided at the back side of the articulating toy mechanism 100 (FIG. 2). In one exemplary form, a first end of the at least one control wire 162 may be anchored to anchor 164 on the secondary linkage 152 of the right articulating wing assembly 130*a* with the other end of the control wire 162 being fed through the through-hole 122 provided by the central docketing mechanism's retaining mechanism 120 and subsequently attached to the anchor 164 on the secondary linkage 152 of the left articulating wing assembly 130*b*. The control wire 162 may be utilized to synchronize the movements of the right articulating wing assembly 130*a* and the left articulating wing assembly 130*b* through the manipulation of control wire 162. For example, a user may hold the central docking mechanism 102 by using the finger holding mechanism 118 with one hand, and with the other hand grasp the portion of the control wire 162 that engages the retaining mechanism 120 provided on the rear face 116 of the central docking mechanism 102. However, depending on the user's hand size, the user may be able to hold the central docking mechanism 102 and manipulate control wire 162 with one hand. By pulling on the control wire 162 in a downward direction, the secondary linkage 152 on the right and left articulating wing assemblies 130*a*, 130*b* simultaneously move in the downward direction to provide a closed configuration (FIG. 1). Conversely, by pulling the control wire 162 in an upward direction, the secondary linkage 152 on the right and left articulating wing assemblies 130*a*, 130*b* simultaneously move in the upward direction to provide an open configuration (FIG. 3). In one exemplary form, the user may pull the control wire 162 in the upward and downward direction rapidly to simulate the natural movements of wings while depressing the action button (not shown, but described hereinabove) to promote simultaneous upward, downward, forward, and backward movement of the articulating wings 130*a*, 130*b* in the three-dimensional axis 144.

Figure 4:
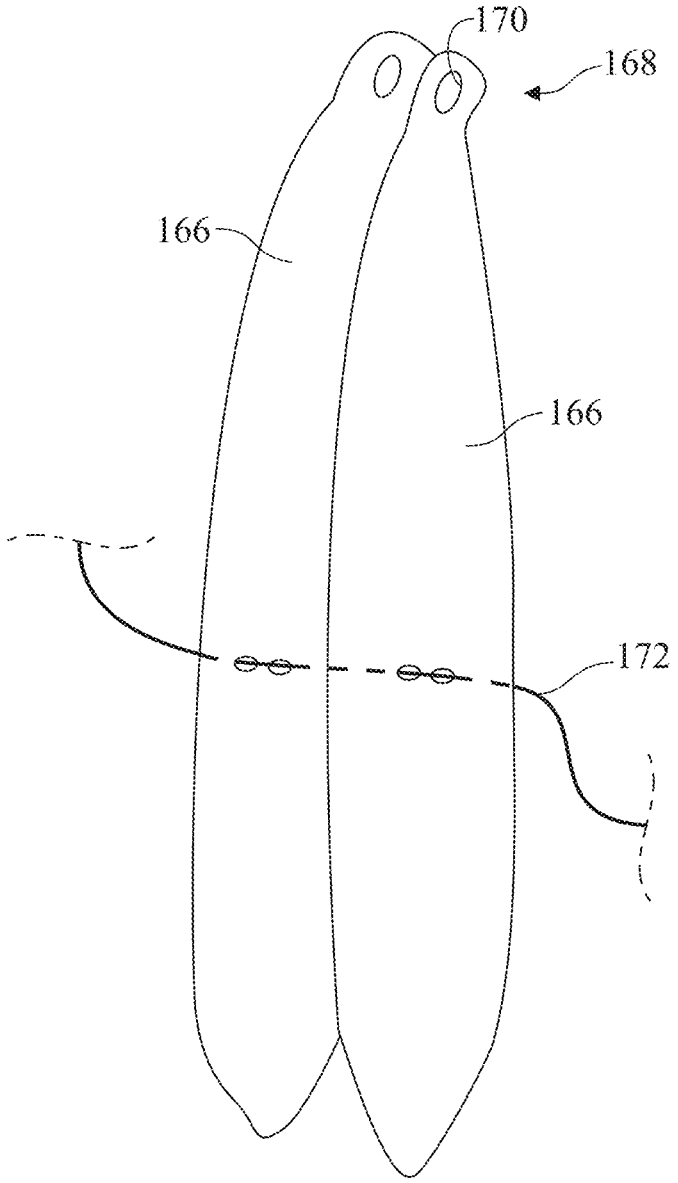
FIG. 4 presents an exemplary illustration of the feather-like elements used on the articulating toy mechanism.

Referring now to FIGS. 2 and 4, each one of the tight and left articulating wing assemblies 130*a*, 130*b* may include a plurality of elements 166 that are designed to replicate the same texture and feel of a real feather. Each element 166 may include a coupling end 168 that includes at least one aperture 170 that engages the plurality of pegs 140 disposed about the backside of the secondary linkage 152 and the primary linkage 132 of each respective articulating wing. In one exemplary embodiment, each feather-like element 166 may be arranged and sutured together via a thread, or monofilament 172 to assimilate the look and feel of a bird's wing. This may be accomplished in one exemplary form by anchoring the monofilament 172 of the articulating toy mechanism 100 to the distal end 154 of a secondary linkage 152, and then sutured through the plurality of feather-like elements 166, and subsequently anchored to the proximal end 136 of the primary linkage 132 of the respective wing assembly. The monofilament 172 sutured to the elements 166 creates a system of elements that are capable of moving in unison with the linkages of the respective wing assemblies that the elements are attached to.

Figure 5:
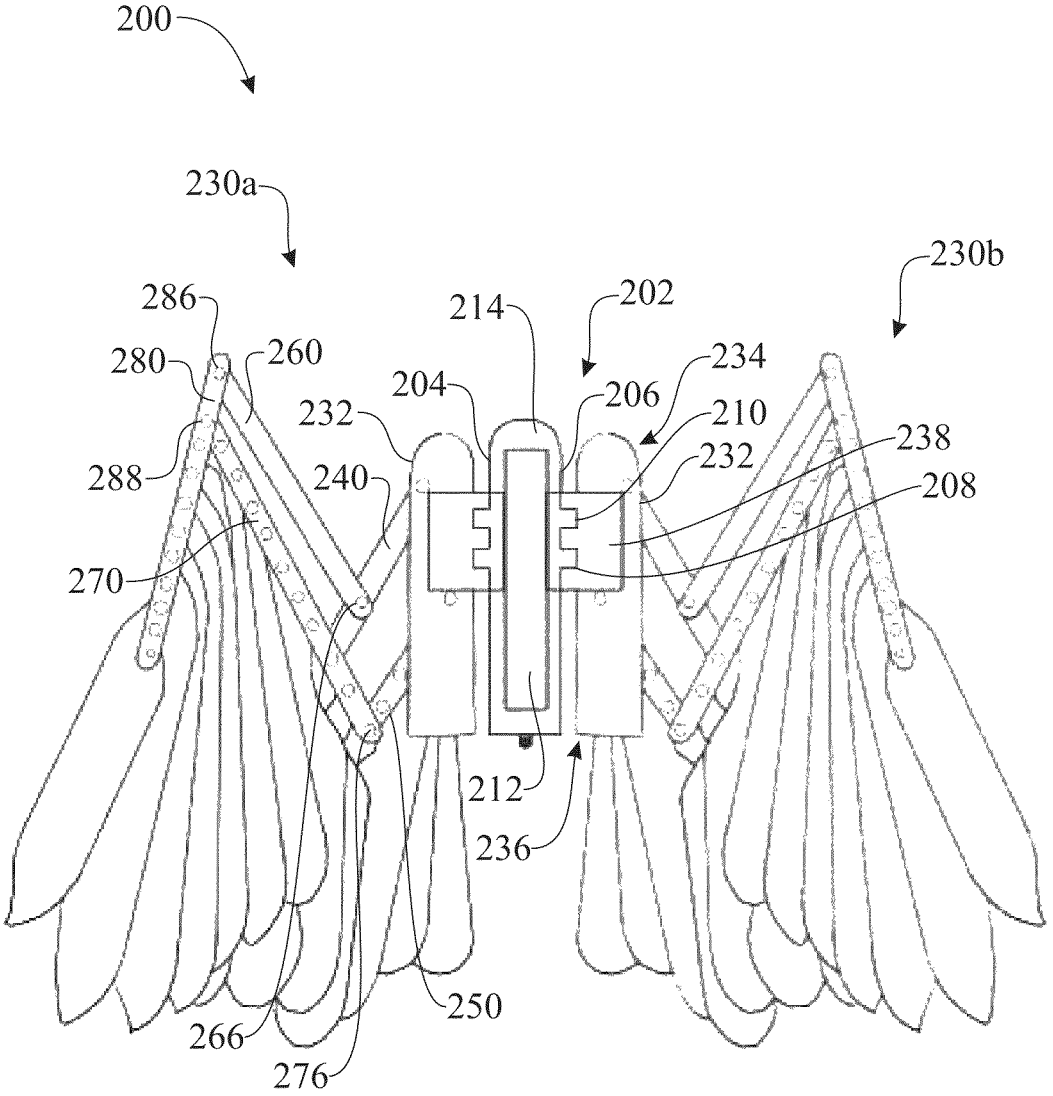
FIG. 5 presents a front side elevation view of a secondary embodiment of the articulating toy mechanism.
Figure 6:
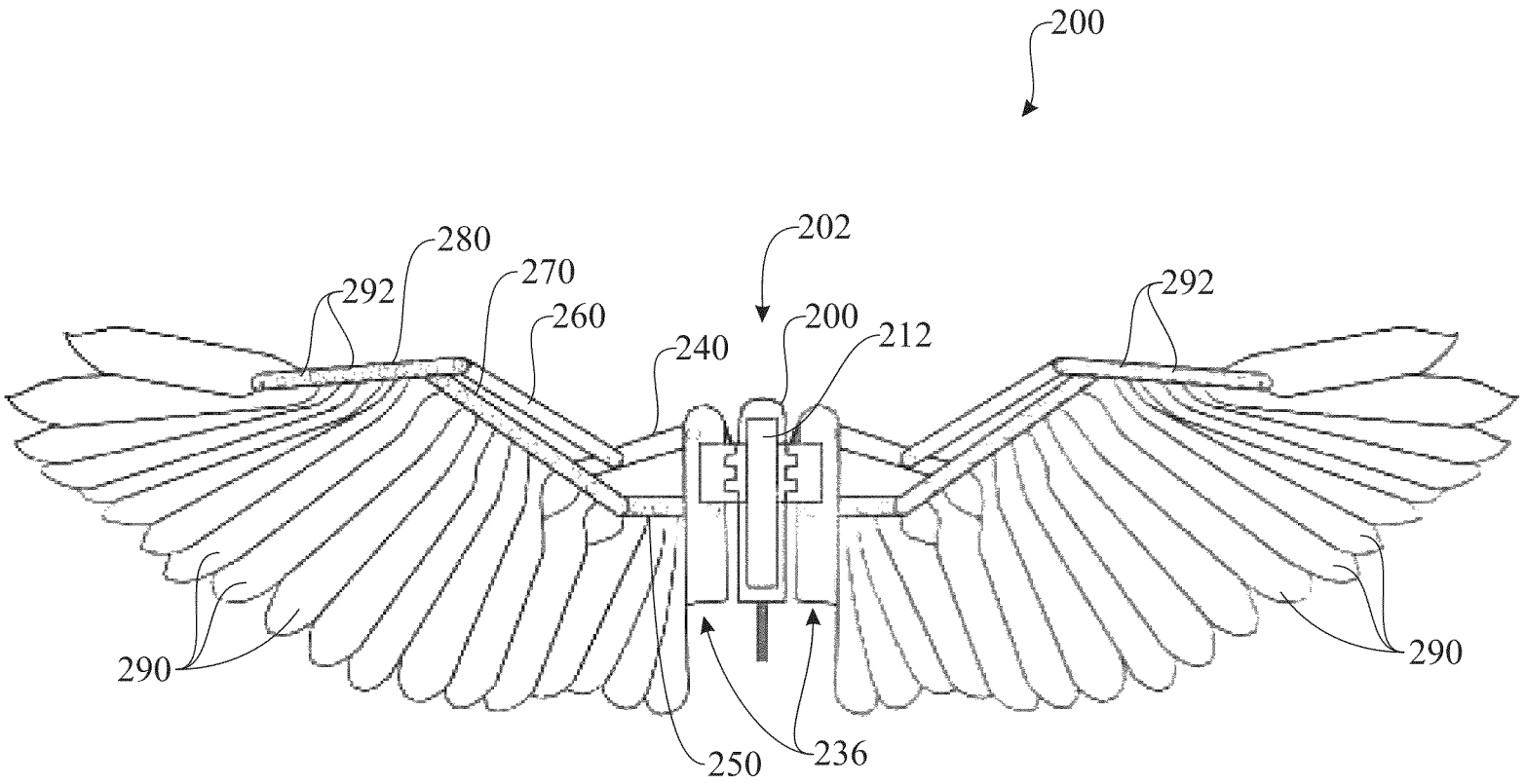
FIG. 6 presents a front side elevation view of the secondary embodiment of the articulating toy mechanism originally shown in FIG. 5, wherein the left and right articulating wing are shown in an expanded or open position.
Figure 7:
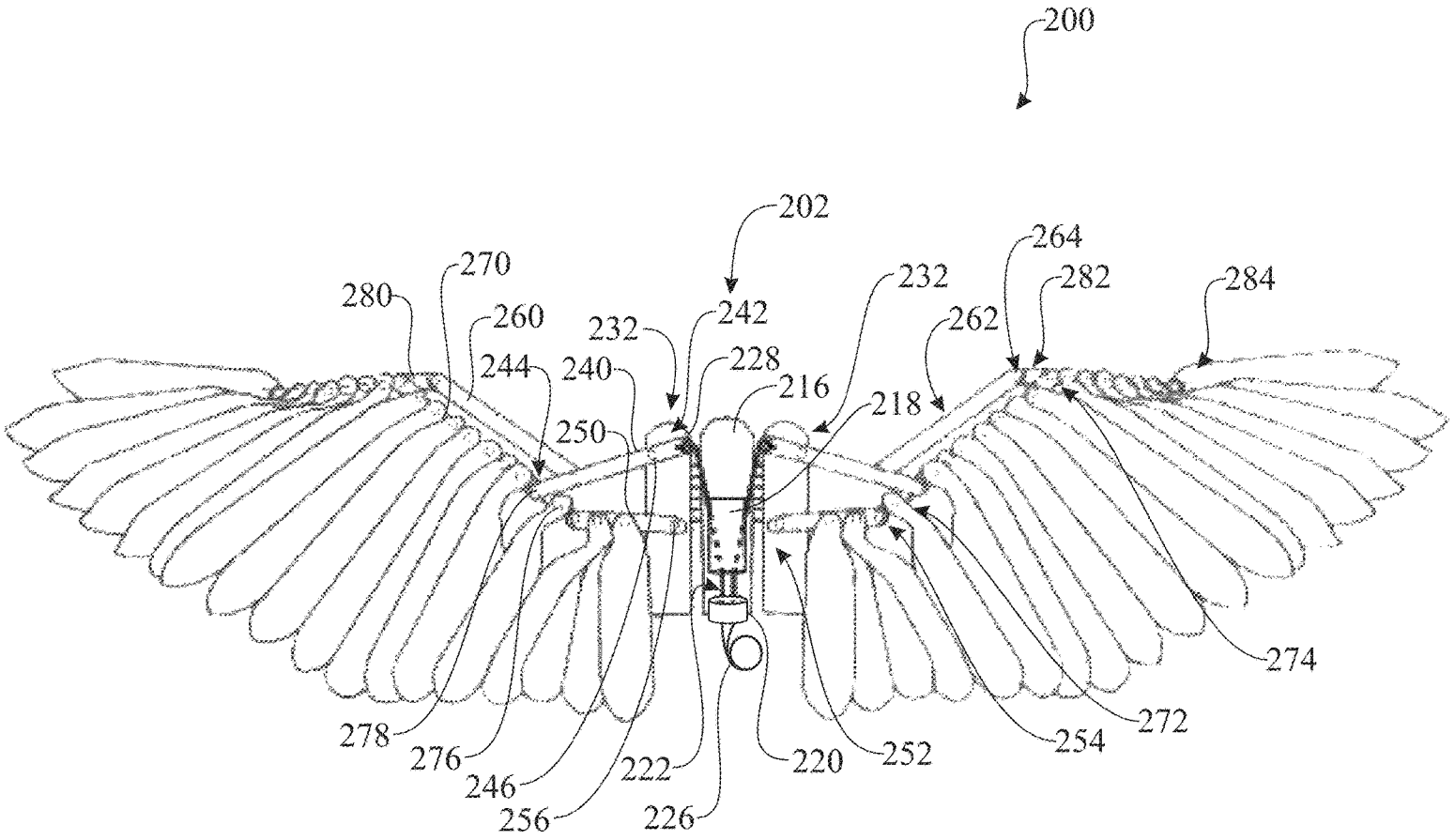
FIG. 7 presents a rear side elevation view of the secondary embodiment of the articulating toy mechanism shown in FIG. 6.

Referring now to FIGS. 5-7, there is disclosed an articulating toy mechanism 200 in accordance with a second embodiment of the invention. The articulating toy mechanism 200 similarly comprises a central docking mechanism 202 and a pair of right and left articulating wing assemblies 230*a*, 230*b*. The central docking mechanism 202 includes a pair of opposite right 204 and left 206 ends. At each opposite end 204, 206 the central docking mechanism may include a right attachment mechanism 208 and a left attachment mechanism 210, respectively. The central docking mechanism 202 also includes a front face 214 and a rear face 216. Disposed about the front face 214 of the central docking mechanism may include a textured surface 212. Similar to the first exemplary embodiment previously described hereinabove, it is contemplated that the central docking mechanism 102 include a mechanical coupling mechanism disposed about the front face 214 of the central docking mechanism 102, that couples the central docking mechanism 102 to a host. Alternatively, the central docking mechanism may include a hook and loop material 212 that secures the central docking mechanism 202 to a host and can subsequently be easily removed.

With reference to FIG. 7, disposed about the rear face 216 of the central docking mechanism 202 is a finger holding mechanism 218. The finger holding mechanism 218 may be provided in the form of an annular ring that is sized and fitted to engage at least one finger of a user. The rear face 216 of the central docking mechanism may also include a retaining mechanism 220 that provides a through-hole 222. The central docking mechanism 202 may also have an action button (not shown) disposed about the docking mechanism's rear face, which may include a spring loaded mechanism that engages the right and left attachment mechanisms 208, 210 to promote horizontal directional movement of the wing assemblies.

Turning now to FIGS. 5 and 6, the articulating toy mechanism 200 includes a right articulating wing assembly 230*a*, and a left articulating wing assembly 230*b*. In similar fashion to the right and left articulating wing assembly of the first exemplary embodiment of the articulating toy mechanism 100 described hereinabove, the wing assemblies of the articulating toy mechanism 200 comprise of the same elements and can be are arranged and connected to the central docking mechanism 202 at opposite ends to create a mirror image duplicate of one another. Therefore, for the sake of brevity like parts and elements will be referenced with identical reference numerals. Each wing assembly includes a primary linkage 232 having a top end 234 and a bottom end 236. Primary linkage 232 may also include an attachment mechanism 238 that is designed and configured to engage with the right and left attachment mechanisms 208, 210 on the opposite ends of the central docking mechanism 202. As shown in FIG. 5, the primary linkage 232 of the right articulating wing 230*a* and the left articulating wing 230*b* may be hingeably coupled in parallel to a respective opposite end of the docking mechanism 202, and may move or swing in a forward or backward motion with respect to the central docking mechanism 202. With reference to FIG. 7, the primary linkage 232 of each respective articulating wing assembly 230*a*, 230*b* may be coupled to a plurality of linkages. The plurality of linkages may include a first linkage 240, a second linkage 250, a third linkage 260, a fourth linkage 270, and a fifth linkage 280. The first linkage 240 includes a proximal end 242 and a distal end 244 with respect to the primary linkage 232. The second linkage 250 is of a smaller length in comparison to the first linkage 240, and includes a proximal end 252 and a distal end 254. The third linkage 260 is if a larger length than the second linkage 240 and includes proximal end 262 and distal end 264. The wing assembly's fourth linkage 270 may be the longest linkage and includes a proximal end 272 and a distal end 274, and the fifth linkage 280 is approximately, the same size as the third linkage 260, and includes a proximal end 282 and a distal end 284. Generally, the linkages of the articulating toy mechanism 200 are generally coupled in a criss-cross pattern which enable the articulating wing assemblies to expand (i.e., open configuration—FIG. 7) and contract (i.e., closed configuration—FIG. 5). Although the general sizes of the linkages have been described herein above, it should be readily understood that their lengths should not be construed as limiting and may vary without departing from the intended scope of the invention.

The assembly process of the right and left articulating wing assembly 230*a*, 230*b* of the secondary embodiment of the articulating toy mechanism 200 will now be described with reference to FIGS. 5 and 7. The proximal end 242 of the first linkage 240 may be coupled to the top end 234 of the articulating toy mechanism's primary linkage 232 at pivot/rotary joint 246. The proximal end 254 of the second linkage 250 may then be coupled to the primary linkage 232 below the first linkage 240 at pivot joint 256 (FIG. 7). The proximal end 262 of the third linkage 260 may be coupled to a mid-section on the front face of the wing's first linkage 240 at pivot joint 266. Once the third linkage 260 has been coupled to the first linkage 240, the proximal end 272 of the fourth linkage 270 may be coupled to the front face of the distal end 254 of the second linkage 250 at pivot joint 276. The fourth linkage 240 may also be coupled to the first linkage 240 at a joint 278. Finally, the proximal end 282 of the fifth linkage 280 may be coupled to the front face of the distal end 264 of the third linkage 260 at pivot joint 286. The fifth linkage 280 may also be coupled to the fourth linkage 270 a distal end 274 thereof at joint 288. It should be readily understood that when the plurality of linkages (i.e., links 1-4) are coupled together they, form a unitary network of mechanical linkages that provide mobility to the articulating wing assembly 230*a*, 230*b*. In one exemplary form, when the wings of the articulating toy mechanism 200 are expanding, the first and second linkage 240, 250 exert a pushing force on the proximal end of the third and fourth linkages 260, 270, with the distal end of the third and fourth linkage 260, 270 extending a similar push force to the fifth linkage 280, thereby causing the distal end 284 of the fifth linkage 280 to move upwardly. The same occurs but in the opposite direction when the wing assembly is contracting (i.e., a pull force is being exerted throughout the system so that the wings close).

With continued reference to FIGS. 6 and 7, the movement of the right and left articulating wing assembly 230*a*, 230*b* may be controlled through the use of control wire 226. In one exemplary form, one end of the control wire 226 may be anchored to the first linkage 240 that is coupled to the primary linkage 232 at anchor 228 on the tight articulating wing assembly 230*a*, with the other end of the control wire 226 being fed through the through-hole 222 provided by the retaining mechanism 220 on the rear face 216 of the docking mechanism, and attached to an anchor 228 on the first linkage 240 of the left articulating wing assembly 230*b*. As previously described hereinabove with respect to the articulating toy mechanism 100, the movements of the right articulating wing assembly 230*a* and the left articulating wing assembly 230*b* may by controlled and synchronized through the manipulation of control wire 226. For example, by pulling on the control wire 226 in a downward direction, the right and left articulating wing assemblies 230*a*, 230*b*, simultaneously move to provide an open configuration (FIG. 6). By pulling the control wire 226 in an upward direction, the right and left articulating wing assemblies 230*a*, 230*b* simultaneously move in the downward direction to provide a closed configuration (FIG. 5).

Attention is now drawn to FIG. 6, each of the right and left articulating wing assemblies 230*a*, 230*b* may include a plurality of feather-like elements 290 that are designed to replicate the feel of a real feather. Similar to the elements 166 described hereinabove concerning the first embodiment of the articulating toy mechanism 100, each feather-like element 290 of the mechanical toy 200 may include at least one aperture that engages the plurality of pegs 292 that are disposed about the backside of each of the linkages that comprise the right and left articulating wing assembly 230*a*, 230*b*.

Referring now to FIGS. 8-11, there is disclosed an articulating toy mechanism 300 in accordance with a third embodiment of the invention where like features of the central docking mechanism 302 of the articulating toy mechanism 300 and the central docking mechanism 102 of the articulating toy mechanism 100 of FIGS. 1-3 are numbered the same except preceded by the numeral '3.'

Figure 9:
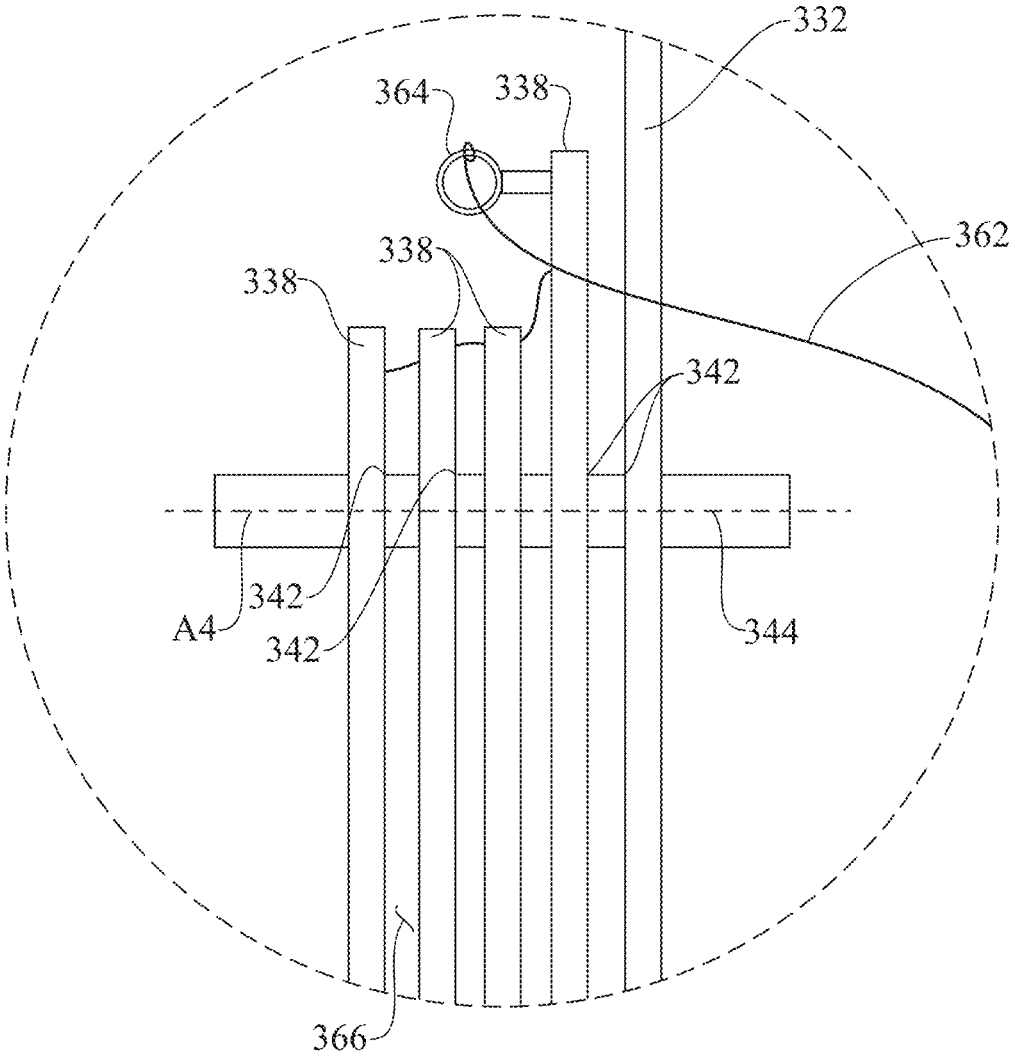
FIG. 9 presents a magnified illustration of the articulating wing assembly of the third embodiment of the articulating toy mechanism originally shown in FIG. 8.
Figure 10:
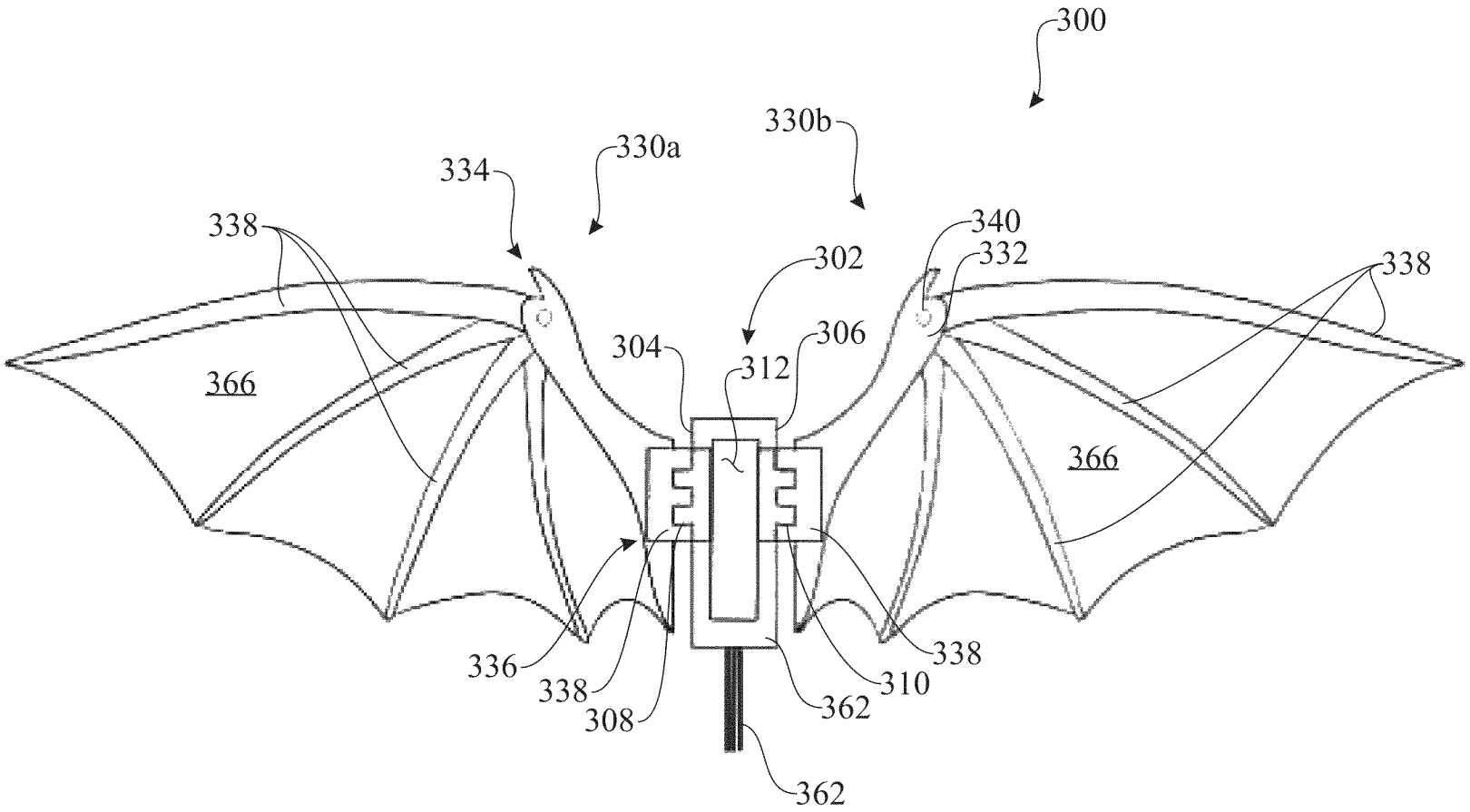
FIG. 10 presents a front side elevation view of the third embodiment of the articulating toy mechanism originally shown in FIG. 8, wherein the left and right articulating wing are shown in an expanded (open) position.
Figure 11:
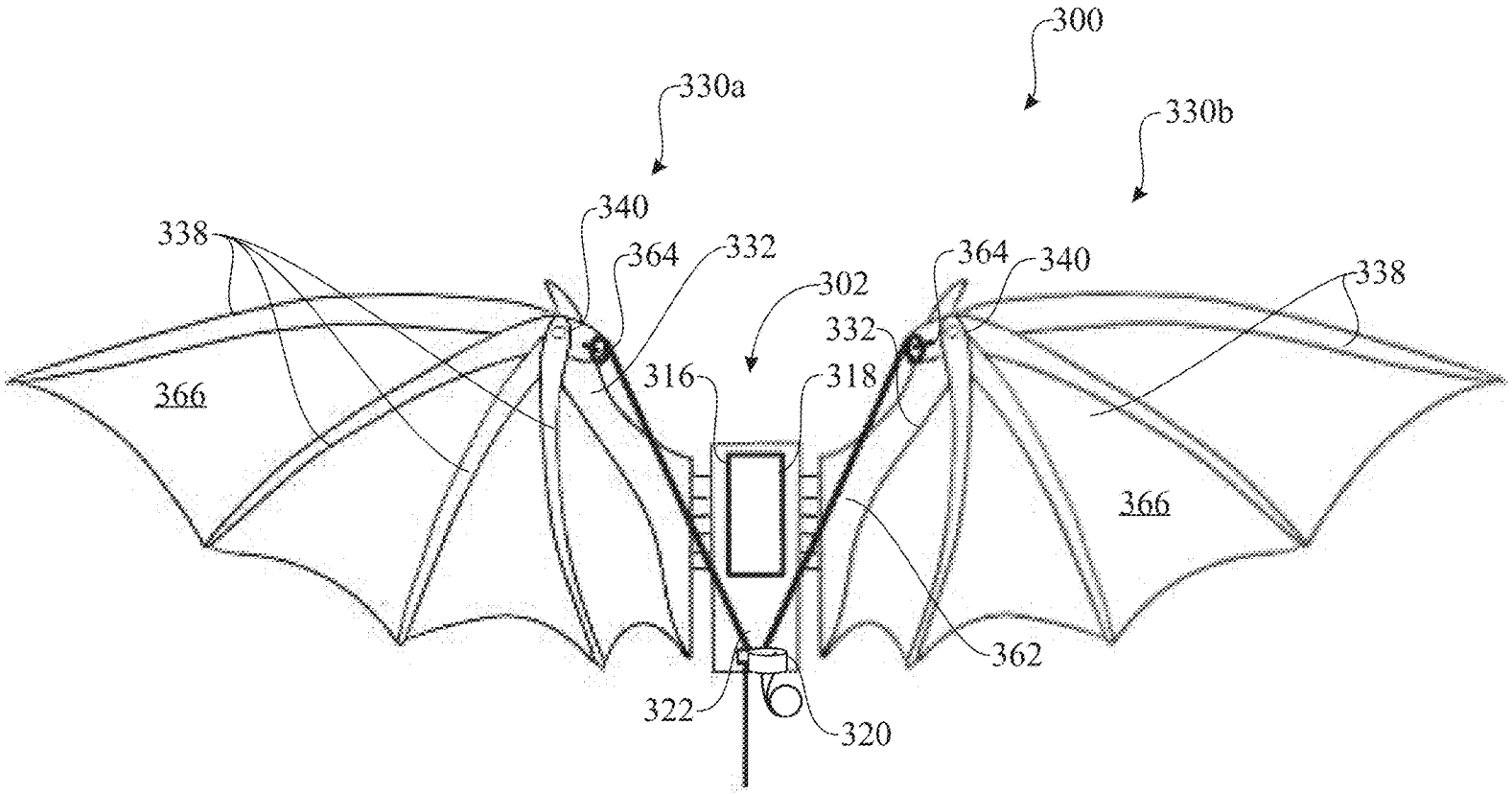
FIG. 11 presents a rear side elevation view of the third embodiment of the articulating toy mechanism shown in FIG. 10.

With reference to FIGS. 10 and 11, the articulating toy mechanism 300 may include a right and left articulating wing assembly 330*a*, 330*b*, with each respective wing assembly including a primary linkage 332 that has a distal end 334 and a proximal end 336. Each primary linkage 332 of each respective wing assembly may include an attachment mechanism 338 that is designed and configured to engage with the right attachment mechanism 308 and the left attachment mechanism 310 disposed about the opposite ends of the central docking mechanism 302. As previously mentioned heretofore, the attachment mechanism 338 may be provided in the form of a hinge joint attachment, or the like, which provides movement in a singular plane or in this particular case in the forward and backward direction with respect to the central docking mechanism 302. Coupled to the backside of the distal end 334 of the primary linkage 332 are a plurality of articulating linkages 338 about a pivot joint 340. As is best illustrated in FIG. 9, primary linkage 332 and linkages 338 may include an opening configured to receive a fastener 344, or peg that the top end of each linkage is supported about. Each of the linkages 338 along with the primary linkage 332 may rotate about a central axis A4 provided by fastener 344 and can articulate to provide an open wing configuration (FIG. 10) and a closed wing configuration (FIG. 8).

Figure 8:
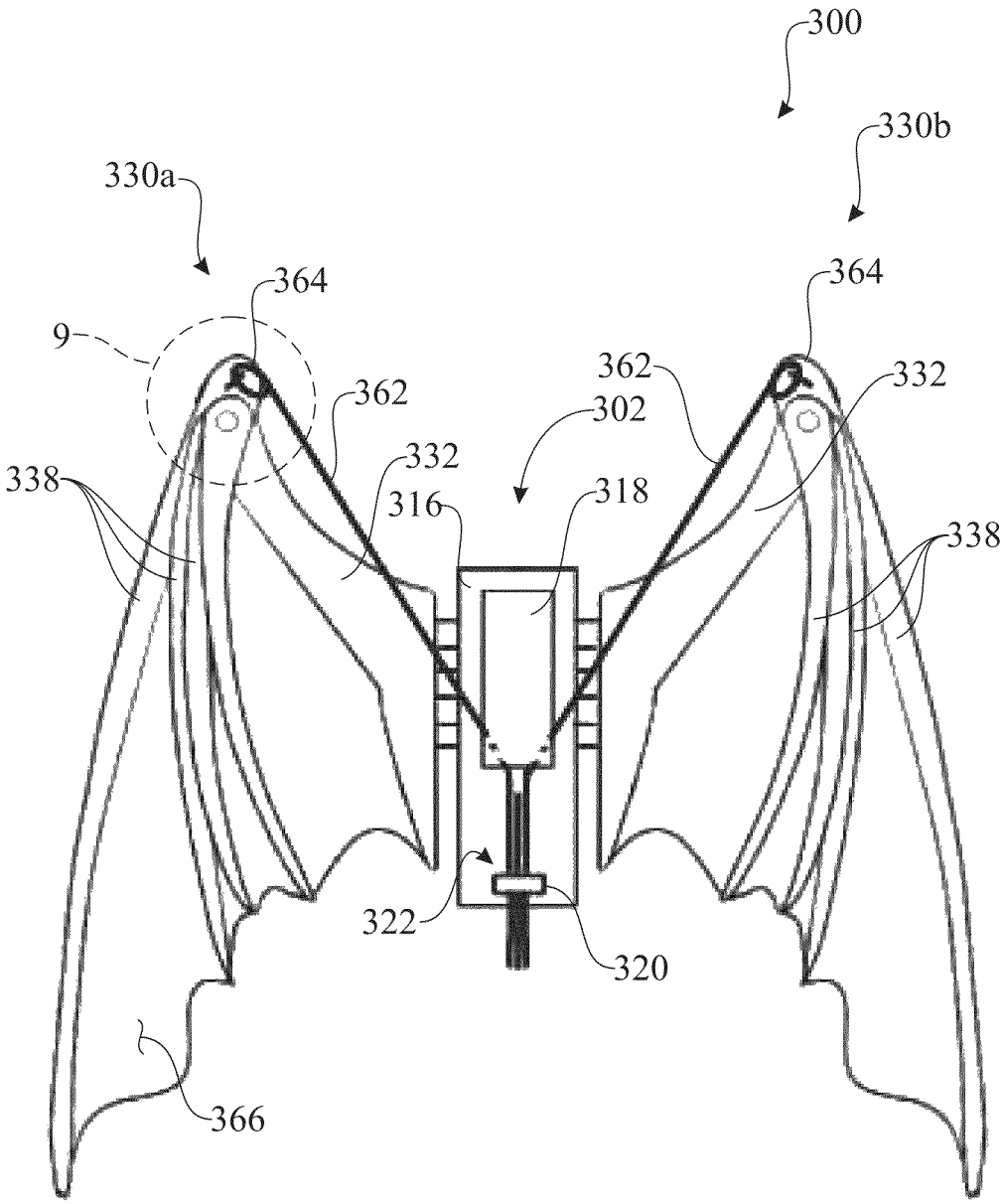
FIG. 8 presents a front side elevation view of a third embodiment of the articulating toy mechanism.

Turning to FIGS. 8 and 11, the movement of the right and left articulating wings 330*a*, 330*b* (i.e., the toggling from an open configuration to a closed wing configuration and vice versa) may be controlled by the pulling of a control wire 362 that may be provided at the backside of the articulating toy mechanism 300. In an exemplary form, a first end of the control wire 362 may be anchored to an anchor 364 disposed about a top end of one of a secondary linkage 338 of the right articulating wing assembly 330*a*, with a second end of the control wire 362 being fed through the through-hole 322 provided by the central docketing mechanism's retaining mechanism 320 and subsequently attached to the anchor 364 disposed about the top end of a secondary linkage 338 on the left articulating wing assembly 330*b*. As described heretofore, the movement of the articulating wing assemblies may be done through the pulling of the control wire 362 in the upward and downward direction. Each right and left articulating wing assembly 330*a*, 330*b* may further include a mesh 366 stretched over and attached to each primary linkage 332 and linkages 338 of each respective wing assembly. In one exemplary form and as shown in FIG. 10, the right and left articulating wing assembly 330*a*, 330*b* may be configured to mimic the style and shape of a batwing. However, alternative shapes and styles may be utilized to provide different but yet creative wing designs.

With reference now to FIGS. 12-18, a fourth embodiment of the articulating toy mechanism 400 is generally shown. Like features of the toy mechanism 400 and the toy mechanism 100 are numbered the same except preceded by the numeral '4.' The toy mechanism 400 generally comprises a central mechanism 402, a left articulating wing assembly 430*b*, and a right articulating wing assembly 430*a*. The central mechanism 402 includes a body having a pair of opposite sides 404, 406 with an attachment mechanism 410 disposed about each side. The attachment mechanism of the toy, in one exemplary embodiment, is a hinge joint that connects to a portion of the articulating wings of the toy mechanism 400. The body of the central mechanism 402 also includes a front face 414, and a rear face 416. Disposed about the rear face 416 of the central mechanism 402 is a holding mechanism 418, and a mechanical device 480 that drives the right and left wing. Opposite the rear face, the front face 414, includes an attachment device 401 that is used to attach a host to the central mechanism of the toy. As explained above, the host (not presently shown) may be any toy. For example, one will appreciate that the present toy mechanism 400 can be attached to an action figure, the torso of a plush toy, or a doll, to name a few. Alternatively, the toy mechanism 400 can be used without a host.

Figure 12:
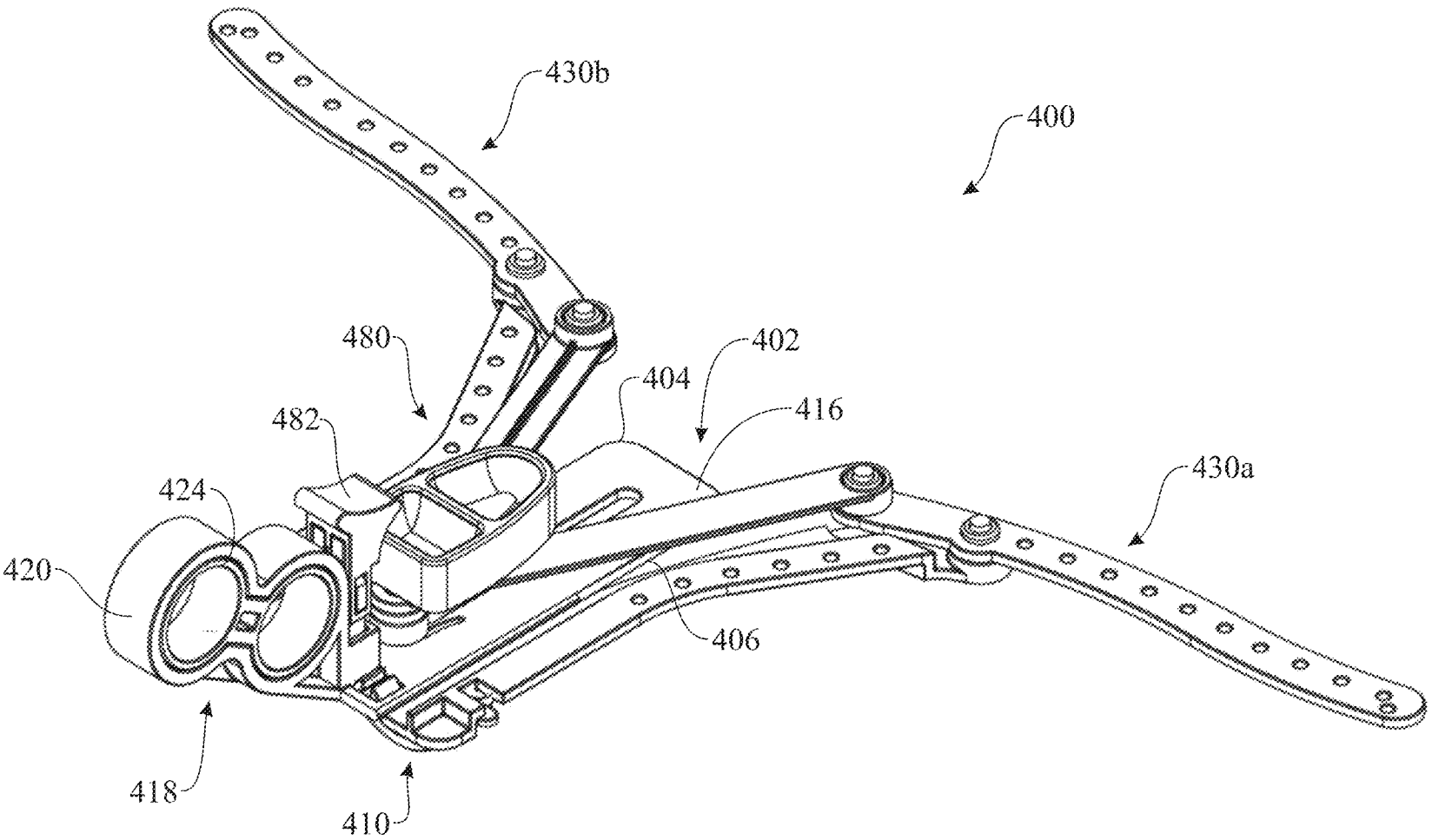
FIG. 12 presents a front perspective view of a fourth embodiment of the articulating toy mechanism.
Figure 13:
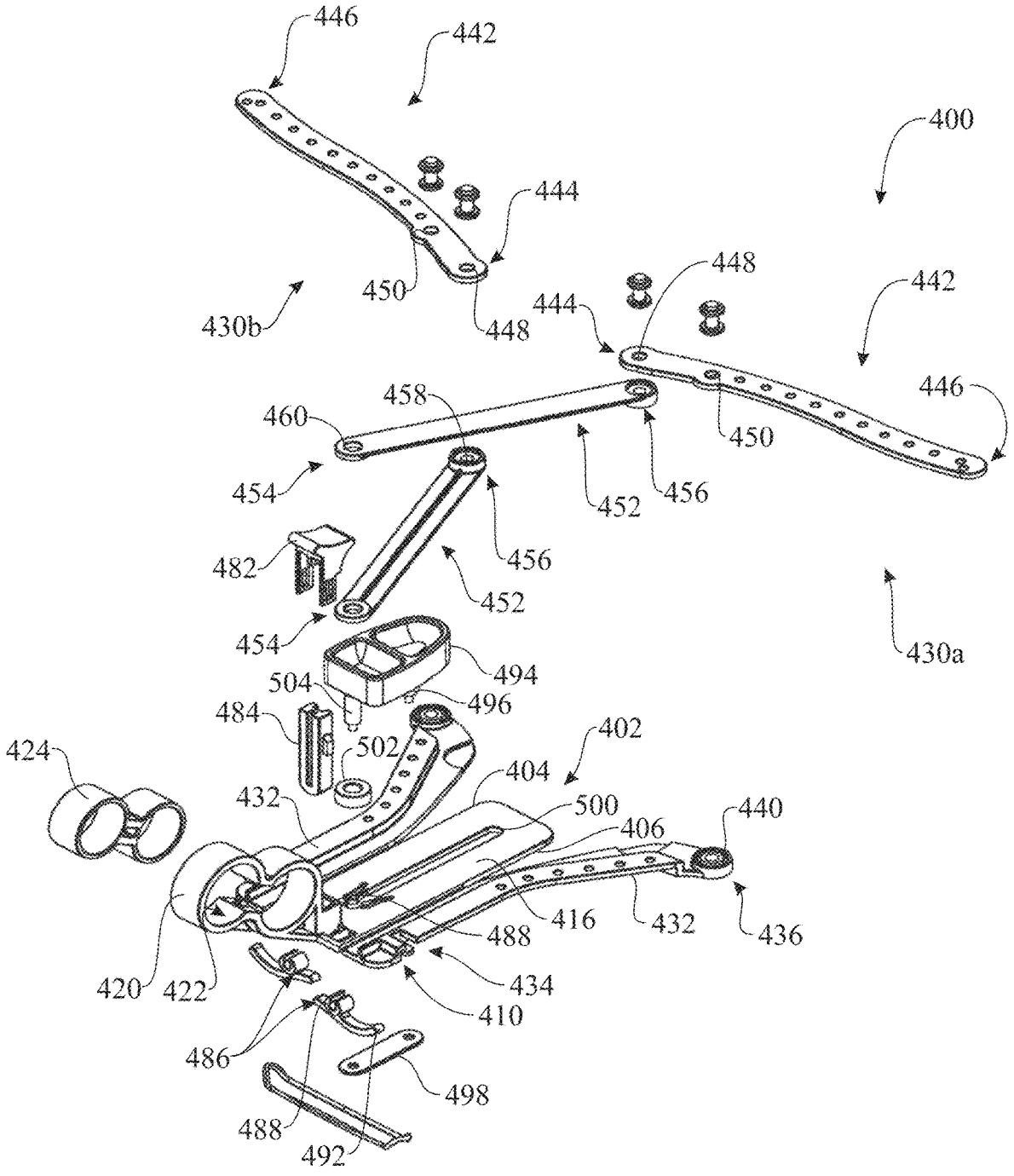
FIG. 13 presents an exploded front perspective view of the fourth embodiment of the articulating toy mechanism presented in 12.

Referring in particular to FIGS. 12 and 13, the holding mechanism 418 includes a body 420 that provides at least one opening 422. The body 420 of the holding mechanism 418 is attached a bottom portion of the rear face 416 of the body of the central mechanism. The opening 422 of the holder is shaped, designed, or otherwise configured to permit a user to use at least one finger to hold the toy mechanism 400. As illustrated in the accompanying figures, however, the central body 420 of the holding mechanism 418 includes at least two openings 422 that are adjacent one another. The holding mechanism 418 also includes a removable insert 424 that fits inside of the opening 422. The removable insert 424 matches the size of the interior diameter of the opening 422, and its shape. For instance, FIG. 13 illustrates a holding mechanism that provides a pair of openings in the shape of the number and the removable insert 424, also shaped like the number i.e., matching the size and shape of the opening. The removable insert 424 is selectively used to change the size of the finger opening 422 of the holding mechanism 400, so that users with different finger sizes can comfortably grasp the toy mechanism 400.

With reference now to FIGS. 13-16, the toy mechanism 400 includes a right and left articulating wing 430*a*, 430*b* that are identical to each other. Accordingly, for the sake of clarity, similar parts of each wing assembly will be numbered the same. The right and left articulating wing 430*a*, 430*b* each include a primary link 432 having a proximal end 434 and a distal end 436. The proximal end 434 includes a connection joint 438 that connects to the attachment mechanism 410 of the central mechanism 402. In the instant case, the attachment mechanism 410 is a hinge joint that connects to the proximal end 434 of the primary link 432. The hinge joint in one exemplary embodiment is a living hinge that allows the primary link to pivot or otherwise swing in the forward and aft direction. The distal end 436 of the primary link 432 extends at a forward angle away from the link's proximal end 434 and includes a connection joint 440. The primary link 432 also includes a plurality of apertures disposed about the link's length. The apertures, as described in previous embodiments above, are used to attach feather-like elements to the wing assembly. The wing assembly 430*a*, 430*b* also include a secondary link 442 that includes a distal end 446 and a proximal end 444. The proximal end 444 of the secondary link 442 includes at least two connection joints 448 and 450, with a first connection joint 448 positioned superior to the second connection joint 450. Like the primary link 432, the secondary link 442 includes a plurality of apertures disposed about the length of the secondary link, with the apertures needed to attach the feather-like elements to the link. The articulating wings also include a pull arm 452 that includes a distal end 456 and a proximal end 454. The distal end and proximal end each include a connection joint 460, 458.

Figure 15:
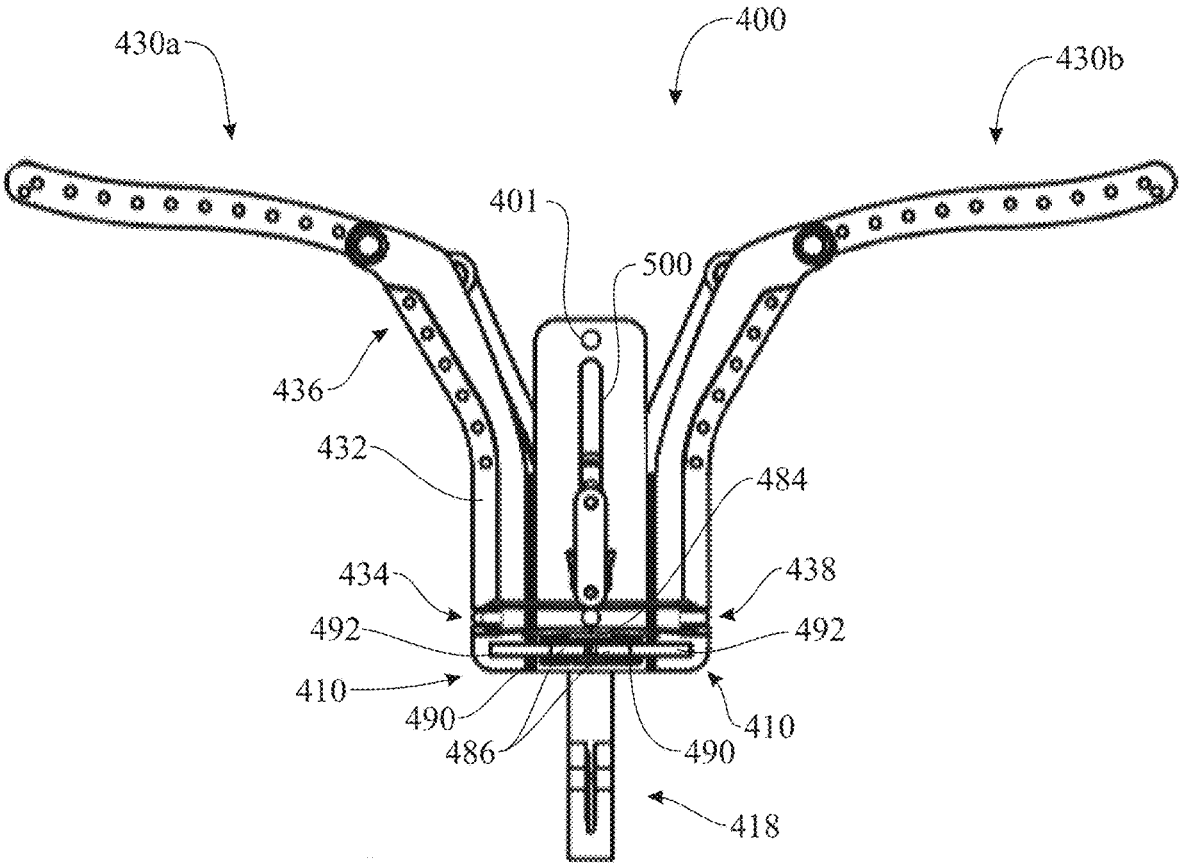
FIG. 15 presents front side elevation view of the fourth embodiment of the articulating toy mechanism presented in FIG. 12, with the articulating wings in an open configuration.
Figure 16:
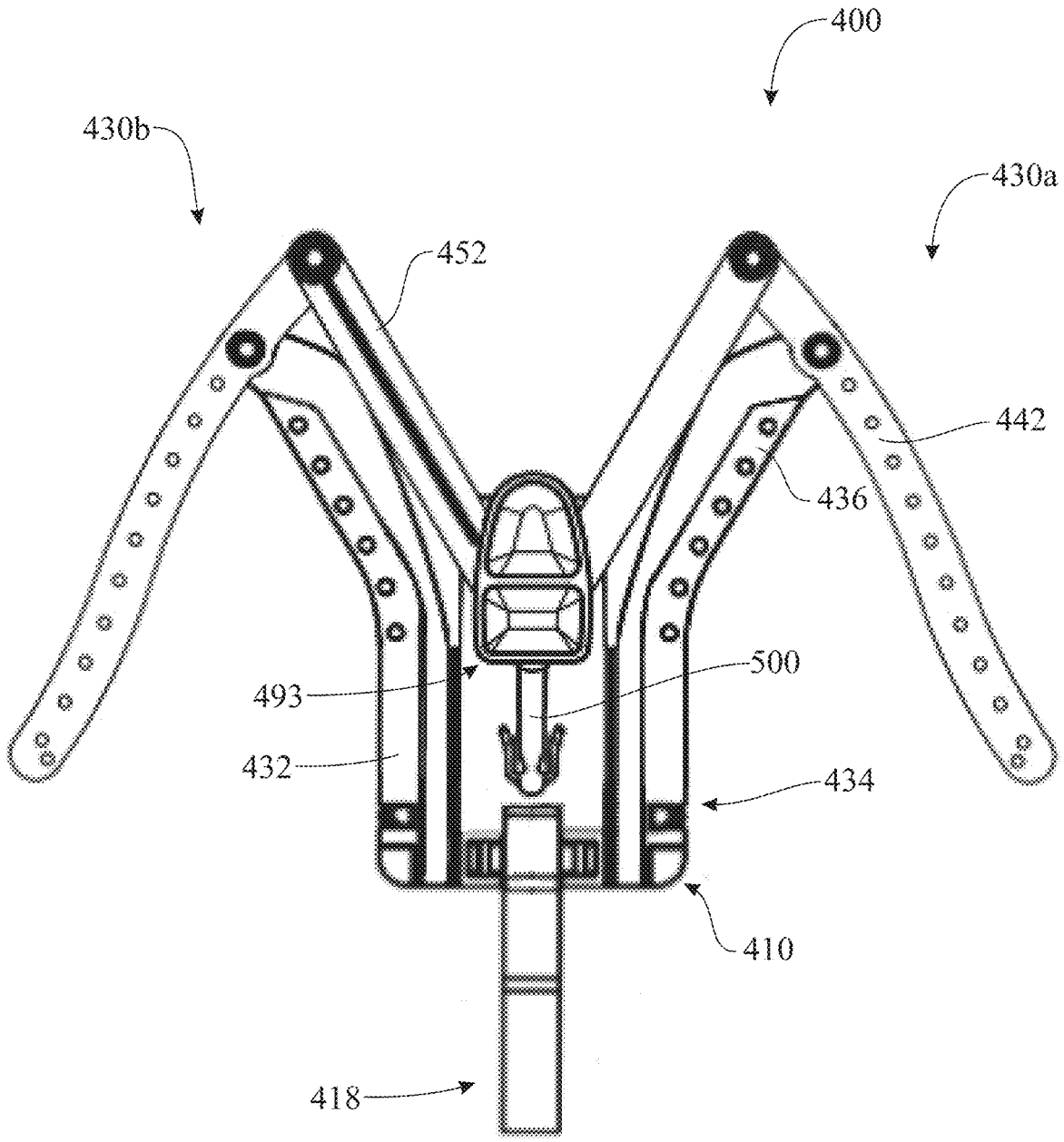
FIG. 16 presents rear side elevation view of the fourth embodiment of the articulating toy mechanism presented in FIG. 12, with the articulating wings in an closed configuration.
Figure 17:
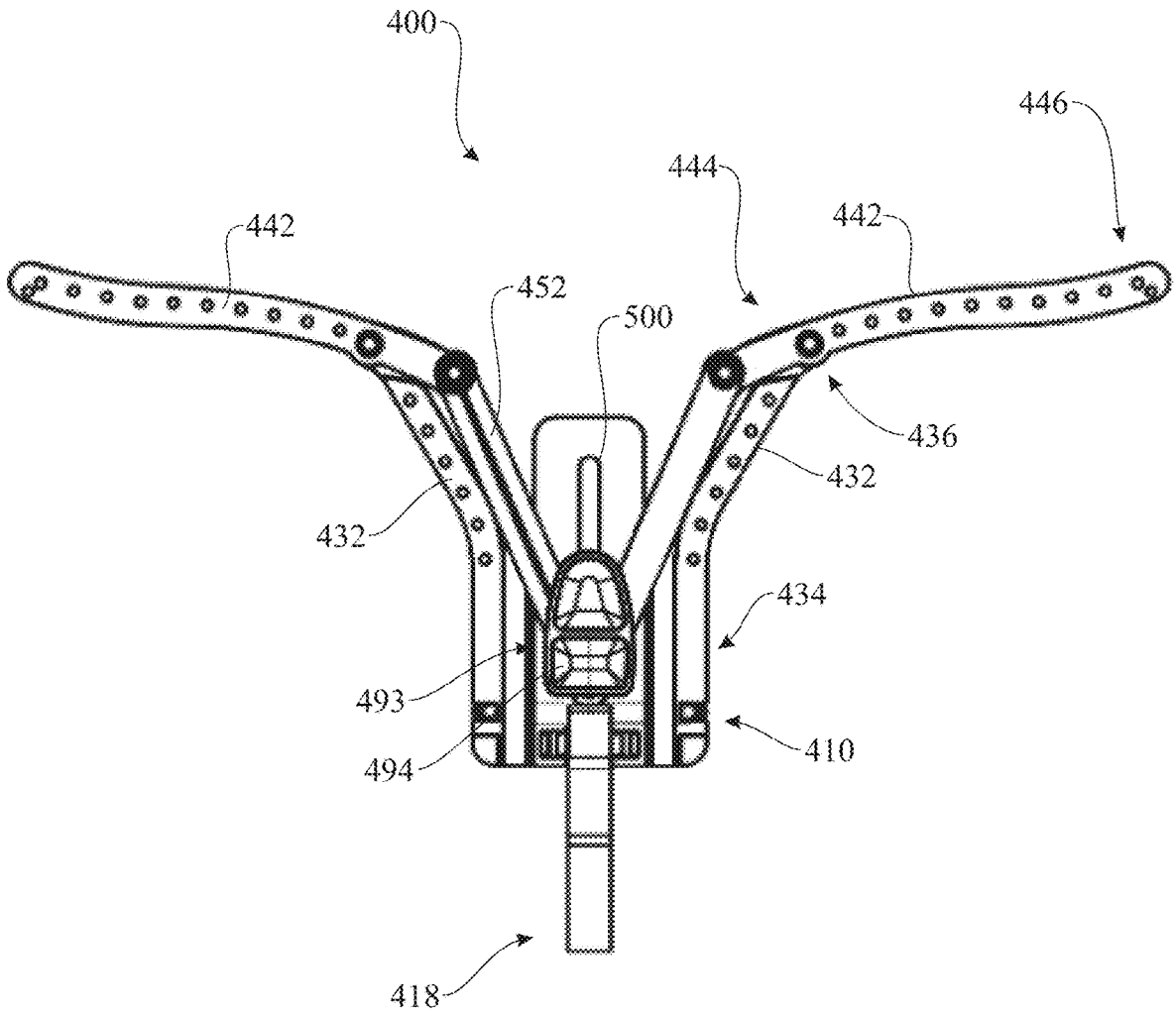
FIG. 17 presents rear side elevation view of the fourth embodiment of the articulating toy mechanism presented in FIG. 12, with the articulating wings in an open configuration.
Figure 18:
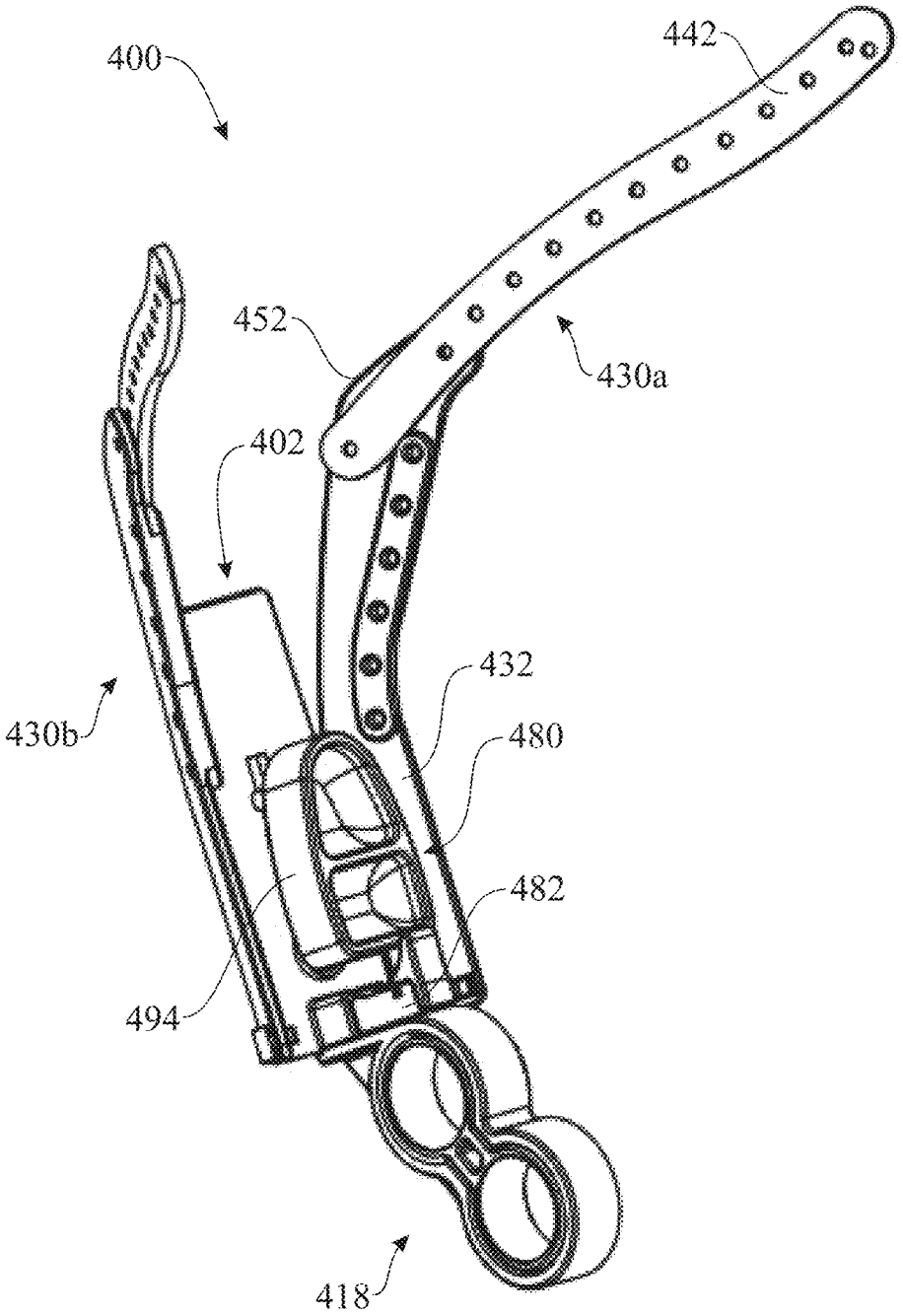
FIG. 18 presents a rear perspective view of the fourth embodiment of the articulating toy mechanism with the right and left articulating wings in an aft position.

Referring now to FIGS. 13, 15, 16, and 17, above or superior to the holding mechanism 418 is the mechanical device 480 of the toy mechanism 400 that drives the articulating wings. The mechanical device 480 includes a depressible button 482 that is attached to a shaft 484 that engages a pair of arms 486. The shaft 484 of the depressible button 482 is inserted through an opening 488 in the rear face 416 of the body that extends through the front face 414 of the central mechanism 402. Each arm 486 generally comprising an elongated curved body with a clip affixed to its body. The clip engages a post on the front face of the body, allowing the arm to pivot about a fixed point. As is best illustrated in FIGS. 15 and 18, when button 482 is depressed, the shaft 484 connected to the button 482 moves and makes contact with an end 488 of the arm 486. The pressure applied by the shaft causes the arm to pivot or rock about the fixed point 490 causing the opposite end 492 to engage the primary link 432 of the articulating wings. The mechanical device 480 may also include a resilient member, such as a rubber band, that applies tension between the wings and prevent unwanted movement. The resilient member is also used to return or snap the right and left articulating wing back to its original position after one releases button 482. For instance, in one exemplary embodiment, button 482 on the mechanical device 480 is utilized to move the articulating wings in the forward and aft direction (relative to the central mechanism) by disrupting or otherwise engaging the resilient member that is applying tension to the wings to remain in a fixed position. The disruption caused by button 482 and the resilient member's innate characteristic to snap the wings back to its original position is what causes the forward and aft movement. In an alternative embodiment, depressible button 482 may be utilized to engage arms 486 to lock the left and right articulating wing in place. That is, prevent the wings from moving in the forward and aft direction. In this particular embodiment, the toy is devoid of the resilient member, allowing each wing to articulate in the forward and aft direction freely. When a user wishes to restrict the movement of the articulating wings, depressing button 482 is depressed to engage arms 486 to lock the left and right articulating wings in place.

Figure 14:
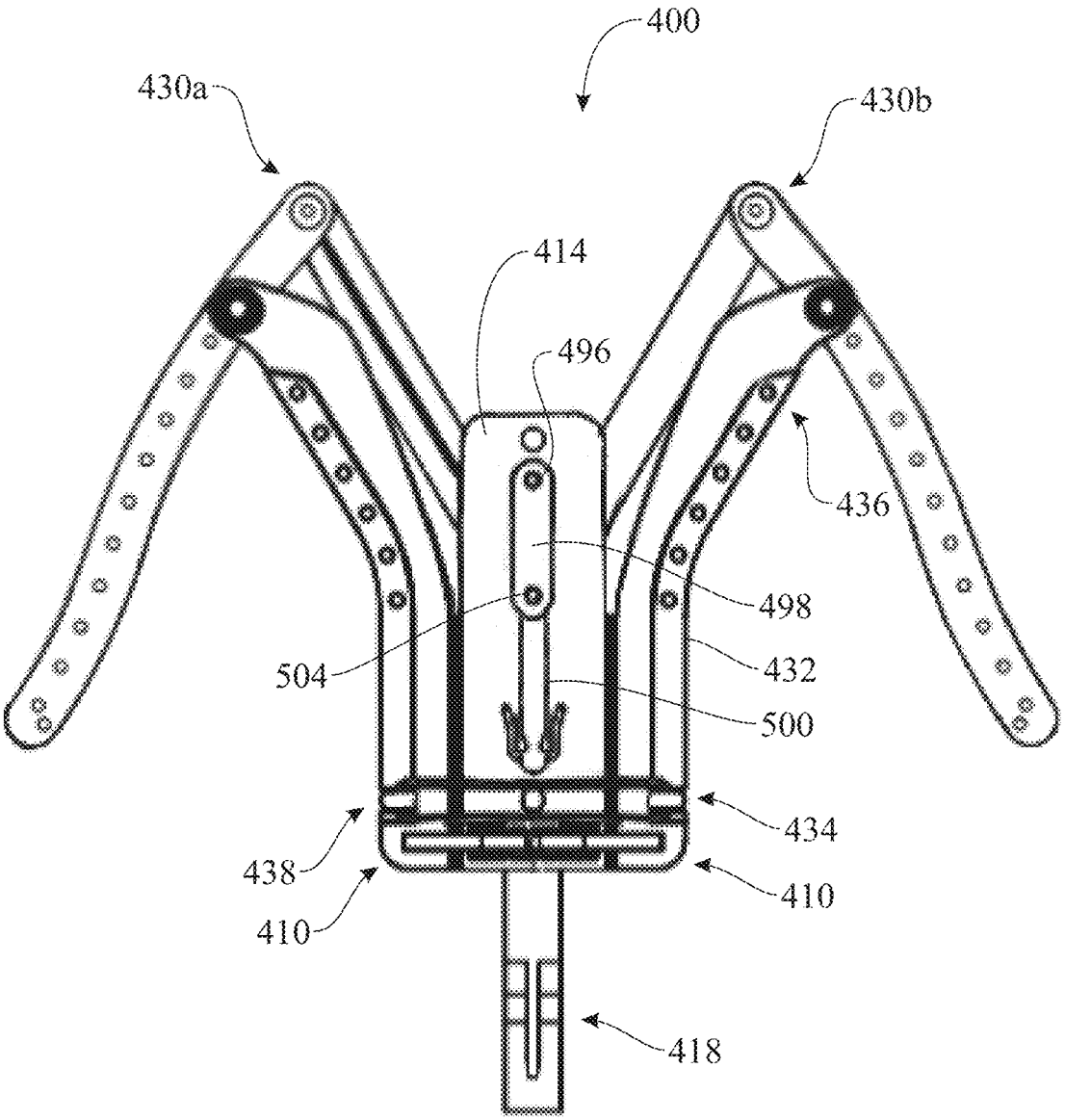
FIG. 14 presents a front side elevation view of the fourth embodiment of the articulating toy mechanism presented in FIG. 12.

The mechanical device 480 also includes a sliding mechanism that drives the movement of the articulating wings in the upward and downward direction. The sliding mechanism generally includes a slider or male member 494 having at least two arms 494, 504 extending away from the rear surface of the male member, a spacer 502, and a receiving member 498 that engages the arms 494, 504. The proximal end of each arm 452 of each articulating wing is connected to at least one arm 496 of the slider 494, with the spacer 502 being coupled to the other arm 504. Both arms extend through the vertical slit 500 on the body of the central mechanism 402 and coupled to the receiving member 498. The 493 sliding mechanism is configured to slide up and down about the vertical slit 500 on the body of the central mechanism. When the slider 494 is slid upwardly, the pull arms 452 coupled to one of the arms 496 moves. Because the arms 452 are connected on both its proximal and distal end, input movement on the arm causes movement of the secondary link 442. In particular, as the proximal end 454 of the arm 452 moves in the upward direction with the slider 494, the secondary link, which is coupled to connection joint 448 to the distal end 456 of the arm, begins to pivot about connection joint 448. As seen in FIG. 14, when the sliding mechanism 493 is in an upward position, the articulating wings are in a closed configuration. Alternatively, as seen in FIG. 15, when the sliding mechanism is in a downward position, the articulating wings are in an open configuration. Accordingly, one will appreciate that the sliding mechanism 493 and the open/close configuration of the articulating wings 430*a*, 403*b* have an inverse relationship.

In summary, the articulating toy mechanism may include a pair of articulating wing assemblies that are designed and otherwise configured to be manipulated by a user and can be mechanically controlled by the hand of the user. The toy mechanism may also include an alternative pair of interchangeable articulating wing assemblies and may be selectively attached and detached to a universal central docking mechanism that may be used to attach a host (i.e., toy) to the docking mechanism.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. An articulating mechanical toy, comprising:

a central mechanism, comprising a central body member that includes a pair of opposite sides, a host attachment mechanism, and a vertical slit extending about a center of the central body member, a holding arm attached to the central body member, and a mechanical device coupled to the central body member that drives the right and left articulating wing;

a left articulating wing; and a right articulating wing, wherein the left articulating wing and the right articulating wing are attached to the central mechanism; and wherein the holding arm includes an opening and a removable insert that is insertable into the opening, the removable insert used to resize the opening of the holding device.

2. The articulating mechanical toy of claim 1, wherein each side of the opposite sides of the central mechanism includes a hinge joint that engages the right and the left articulating wing, respectively.

3. The articulating mechanical toy of claim 1, the mechanical device comprising, a depressible button; and a sliding member, wherein the sliding member slides about the vertical slit of the central body member of the central mechanism.

4. The articulating mechanical toy of claim 3, wherein the right articulating wing and the left articulating wing move when a user engages the depressible button or the sliding member.

5. The articulating mechanical toy of claim 1, the left and right articulating wing each comprise, a primary link connected to the central mechanism;

at least a secondary link connected the primary link; and a pull arm connected to the secondary link on one end and connected to the central mechanism on an opposite end.

6. The articulating mechanical toy of claim 1, wherein three-dimensional movement of the left articulating wing is mirrored by the three-dimensional movement of the right articulating wing, and vice-a-versa.

7. The articulating mechanical toy of claim 1, wherein the left and the right articulating wing can flap in a forward, aft, upward, and downward direction.

8. The articulating mechanical toy of claim 1, further comprising a plurality of feather-like elements that are selectively attached to a plurality of linkages provided by the left and right articulating wings.

9. An articulating mechanical toy, comprising a central mechanism, comprising a central body member that includes a front face, a rear face, a pair of opposite sides, and a vertical slit about a center of the central body member, a holding device attached to the rear face of the central body member, the holding arm includes a body with an opening and a removable insert that is insertable into the opening, the removable insert used to resize the opening of the holding device, and a mechanical device coupled to the central body member, the mechanical device comprising;

a depressible button, and a sliding member, wherein the vertically sliding member slides about the vertical slit of the central body member of the central mechanism;

a left articulating wing; and a right articulating wing, wherein the left articulating wing and the right articulating wing are attached to the central mechanism at hinge joints disposed about each side of the central body member of the central mechanism.

10. The articulating mechanical toy of claim 9, the left and the right articulating wing each comprising, a primary link that includes a proximal end, and a distal end having a connection joint, the proximal end of the primary link hingeably connected to the central mechanism of the articulating toy mechanism at the hinge joint, and the distal end of the primary link extending at an angle from the proximal end, away from the central mechanism;

a secondary link that includes a proximal end and a distal end, the proximal end having a pair of connection joints with a first connection joint superior to a secondary connection joint; and a pull arm that includes a proximal end and a distal end, the proximal end and the distal end of the pull arm each including at least one connection joint, wherein the secondary connection joint, inferior to the first connection joint, of the secondary link is connected to the connection joint of the primary link, and wherein the connection joint of the proximal end of the pull arm is connected to the mechanical device, and the connection joint of the distal end of the pull arm is connected to the first connection joint of the secondary link.

11. The articulating mechanical toy of claim 10, wherein the pull arm is connected to the sliding member of the mechanical device coupled to the central mechanism, the sliding member configured to slide in the upward and downward direction about the vertical slit, moving the sliding members moves the pull arm causing the secondary link to pivot about the secondary connection joint where the secondary link is connected to the connection joint of the primary link, the sliding member configured to cause movement of the right and left articulating wings in the upward and downward direction, and the depressible button engages a pair of arms disposed about the front side of the central body member of the central mechanism such that when the depressible button is depressed the right and left articulating wing move in the forward and aft direction.

12. The articulating mechanical toy of claim 9, further comprising a plurality of feather-like elements that are selectively attached to the left and right articulating wing.

13. The articulating mechanical toy of claim 9, wherein the left and the right articulating wings can flap in the forward, aft, upward, and downward direction.

14. An articulating mechanical toy, comprising:

a central mechanism, comprising a central body member that includes a front face, a rear face, a pair of opposite ends, a pair of opposite sides, a host attachment mechanism, and a vertical slit about a center of the central body member, a finger holding arm attached to the rear face of the central body member, the finger holding arm includes a pair of finger openings proximate to one another, and a removable insert matching the shape of the pair of finger openings, the removable insert used to resize the pair of finger openings of the finger holding arm to accept fingers of different sizes, and a mechanical device coupled to the central body member, the mechanical device comprising;

a depressible button, and a sliding member, wherein the vertically sliding member slides about the vertical slit of the central body member of the central mechanism, a left articulating wing and a right articulating wing, each comprising a primary link that includes a proximal end, and a distal end that includes a connection joint, the proximal end of the primary link hingeably connected to the central mechanism of the articulating toy mechanism at the hinge joint, and the distal end of the primary link extending at an angle from the proximal end, away from the central mechanism;

a secondary link that includes a proximal end and a distal end, the proximal end including at a pair of connection joints with a first connection joint superior to a secondary connection joint; and a pull arm that includes a proximal end and a distal end, the proximal end and the distal end of the arm each including at least one connection joint, wherein the secondary connection joint, inferior to the first connection joint, is connected to the connection joint of the primary link, and wherein the connection joint of the proximal end of the pull arm is connected to the sliding member of the mechanical device, and the connection joint of the distal end of the pull arm is connected to the first connection joint of the secondary link; and a plurality of feather-like elements, wherein the plurality of feather-like elements are selective attached to the primary and the secondary linkages of the left and right articulating wings.

15. The articulating mechanical toy of claim 14, wherein the left and right articulating wings can flap in the forward and aft direction, and a portion of the left and right articulating wings can flap in the upward and downward direction.

16. The articulating mechanical toy of claim 14, wherein the opposite ends of the central body member extend parallel one another, and the opposite sides of the central body member also extend parallel one another, and the opposite sides intersect the opposite ends, the length of the opposite ends being of a smaller length than the opposite sides.

17. The articulating mechanical toy of claim 14, wherein the feather-like elements are sutured to the primary link and the secondary link.

18. The articulating mechanical toy of claim 14, wherein the articulating mechanical toy is removably attachable to a body of a host with the use of the host attachment mechanism.

* * * * *